US006482055B1

(12) United States Patent
Freitag

(10) Patent No.: US 6,482,055 B1
(45) Date of Patent: Nov. 19, 2002

(54) WATER JET PROPULSION UNIT HAVING LINEAR WEED GRATE CLEAN-OUT SYSTEM

(75) Inventor: Michael W. Freitag, Kenosha, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/927,713

(22) Filed: Aug. 11, 2001

(51) Int. Cl.[7] ..... B63H 11/01
(52) U.S. Cl. ..... 440/46
(58) Field of Search ..... 440/46, 47

(56) References Cited

U.S. PATENT DOCUMENTS

| | | | | |
|---|---|---|---|---|
| 3,253,567 | A | 5/1966 | Patton, Jr. | 440/46 |
| 3,279,414 | A | 10/1966 | Rabald | 440/46 |
| 3,343,368 | A | 9/1967 | Castoldi | 440/46 |
| 3,797,447 | A | 3/1974 | Stubblefield | 440/46 |
| 4,027,617 | A | 6/1977 | Ikeda et al. | 440/46 |
| 4,373,919 | A | 2/1983 | Stangeland | 440/46 |
| 4,538,996 | A | 9/1985 | Inwood | 440/38 |
| 4,549,868 | A | 10/1985 | Lolly | 440/42 |
| 4,925,412 | A | 5/1990 | Karls | 440/71 |
| 5,083,948 | A | 1/1992 | Grobson | 440/49 |
| 5,123,867 | A | 6/1992 | Broinowski | 440/42 |
| 5,509,832 | A | 4/1996 | Roos | 440/47 |
| 5,577,941 | A | 11/1996 | Chartier | 440/46 |
| 5,690,520 | A | 11/1997 | Rheault | 440/46 |
| 5,876,258 | A | 3/1999 | Gray | 440/46 |
| 5,989,083 | A | 11/1999 | Ishigaki et al. | 440/46 |
| 6,083,063 | A | 7/2000 | Neisen | 440/46 |

*Primary Examiner*—Jesus D. Sotelo
(74) *Attorney, Agent, or Firm*—Ostrager Chong & Flaherty LLP

(57) ABSTRACT

A mechanism for cleaning out an inlet grate of a water jet propulsion system. The mechanism includes an actuator and a wiper. The actuator penetrates and is supported by a through-hull housing installed in an opening in the hull. The actuator is linearly displaceable relative to the through-hull housing by manipulation of a handle or other operator input device or system. An inlet grate comprising a plurality of cantilever tines is pivotably mounted to and supported by the through-hull housing. A weed wiper is connected to the end of the actuator remote from the end that is actuated by the boat operator. When the actuator is displaced downward, the weed wiper moves downward along a linear path. At the point in the wiper displacement where the wiper bar engages the tines of the inlet grate, the downwardly displacing weed wiper causes the grate to pivot downward. During this action, the wiper slides across the grate and pushes any weeds or other debris entangled on the grate toward the ends of the tines. Because weeds usually wrap and ball around the inlet grate tines, the weeds will slide off easily when pushed or dragged by the sweeping wiper bar.

38 Claims, 4 Drawing Sheets

WATER JET PROPULSION UNIT HAVING LINEAR WEED GRATE CLEAN-OUT SYSTEM

FIELD OF THE INVENTION

This invention generally relates to water jet apparatus which are mounted to the hull of a boat or other watercraft. In particular, the invention relates to mechanisms for cleaning out an inlet grate of a water jet apparatus which has become clogged with weeds or other debris.

BACKGROUND OF THE INVENTION

It is known to propel a boat or other watercraft using a water jet apparatus mounted to the hull, with the powerhead being placed inside (inboard) the hull. The drive shaft of the water jet apparatus is coupled to the output shaft of the inboard motor. The impeller is mounted on the drive shaft and housed in a jet propulsion duct.

To facilitate use of water jet-propelled boats in shallow water, it is known to mount the water jet apparatus at an elevation such that the apparatus does not project below the bottom of the boat hull. In one type of design, part of the duct of the water jet apparatus is installed inside the hull while the remaining part penetrates the transom and extends beyond the rear of the hull. An inlet housing of the duct has a horizontal opening and an inlet ramp for guiding water into the housing where the impeller resides. The horizontal opening of the inlet housing is mounted in a hole in the bottom or near the bottom of the hull. A midportion of the duct penetrates a hole in the transom. A water jet stream is discharged out a steering nozzle pivotably mounted to the distal end of the duct.

When operating a water jet-propelled boat in shallow water, it is possible to ingest seaweed and other debris into the duct when water is being drawn into the water jet inlet. To prevent seaweed and other debris from entering the water jet duct and possibly ensnarling or damaging the rotating impeller, a grate or screen is typically placed across the inlet opening. During continuous use of a water jet-propelled watercraft in shallow, weed-infested water, floating weeds can accumulate on and become entangled with the inlet grate to such a degree that the inlet grate becomes clogged. In particular, in the case where the inlet grate comprises an array of mutually parallel tines, the suction created by the impeller causes weeds and other debris to wrap around the tines of the grate and slide rearwardly along the tines. The buildup of weeds, if allowed to continue unabated, can ultimately form a dense mass that reduces the intake of water through the inlet opening and into the water jet. Reduced water flow can cause the jet pump to stall and the boat to stop moving.

The result is that the boat operator must unclog the inlet opening by removing the dense mass of entangled weeds from the tines of the inlet grate. However, removing entangled weeds from the inlet grate can be very difficult. This task can also be unpleasant if a person has to enter the water and submerge under the boat to remove the weeds from the grate. Moreover, even if the entangled weeds are successfully removed, when boat operation is resumed and the boat operator attempts to leave the weeded area, the inlet grate may become plugged after only a short distance, repeating the same clean-out problem.

One method which has been tried to eliminate this problem uses a cantilevered grate that is attached to the top of the inlet housing through a pivot pin. When the grate becomes clogged with weeds, a lever is activated inside the boat that allows the grate to rotate down away from the inlet. The operator then drives the boat forward and the weeds are supposed to slide off the ends of the inlet grate tines. The inlet grate is then rotated back into place.

Another attempt at a solution to the problem of clogged inlet grates was disclosed in U.S. Pat. No. 5,577,941. In that disclosure, the inlet grate comprises a plurality of cantilever tines which extend rearwardly across the water intake and have suspended aft end tips spaced from the aft end of the water intake. This spacing enables rearward sliding of weeds and other debris along and then off of the cantilever tines without clogging. U.S. Pat. No. 5,577,941 characterizes this anti-clogging feature as being "automatic", with no additional mechanism being needed for unclogging.

U.S. Pat. No. 5,876,258 purports to be an improvement over the teaching of U.S. Pat. No. 5,577,941. In particular, U.S. Pat. No. 5,876,258 states that the inlet grate of U.S. Pat. No. 5,577,941 is problematic because the size of the gap between the end tips of the tines and the aft end of the weed grate plate limits the size and amount of weeds that can pass through the gap and through the water jet. Thus, large clumps of weeds which have a thickness greater than the gap between the tines and the aft end of the inlet grate can cause clogging. Instead, U.S. Pat. No. 5,876,258 proposes an inlet grate comprising a plurality of cantilever tines each joined to a pivot rod. The cantilever tines extend across the inlet opening to prevent debris from entering the water jet. A spring member is mounted between the cantilever tines and a mounting frame such that the spring member provides an outward rotational bias force against the rotatable cantilever tines. During operation of the watercraft, if a mass of weeds becomes clogged in the cantilever tines, the upward and inward suction force of the water jet causes the cantilever tines to rotate upward against the opposing rotational bias force of the spring member. This self-activating mechanism allows the weeds to slide off of the ends of the cantilever tines and be ingested by the water jet. This has the disadvantage that large volumes of weeds will plug up the water jet at the impeller, making clean-out even more difficult than with a fixed-grate system. Also, when the inlet grate is open, hard debris, such as oysters, stones and sticks, can enter the water jet, causing damage to the impeller.

Another grate clean-out device was disclosed in U.S. Pat. No. 6,083,063. This device comprises a cantilevered inlet grate which is pivotably mounted to the top of an inlet housing. The rotation of a lever inside the boat causes the wiper bar to wipe across the top of the tines, which in turn causes the grate to rotate down while causing the weeds to slide off the ends of the tines.

There is a need for an inlet grate clean-out mechanism which can be reliably actuated by a boat operator when conditions require without ingesting weeds or debris into the water jet and which has simplified mechanics.

SUMMARY OF THE INVENTION

The present invention is directed to an operator-actuated inlet grate clean-out mechanism which can be actuated as often as required and which has simple mechanics. By linearly displacing an actuator, e.g., by depressing a sliding rod, located in the boat stern, a person can operate a weed wiper which is pivotably coupled to the end of the actuator. The weed wiper is arranged to push weeds off of a pivotable cantilever-tine inlet grate as the wiper travels along the tines toward their tips. As the wiper sweeps along the inlet grate tines, it bears against the inlet grate and causes the grate to swing downward. Because the weeds wrap and ball around the inlet grate, they also slide off easily when pushed or dragged by the sweeping wiper bar even in large quantities. The invention enables fast and easy weed removal, without the necessity of the boat operator entering the water.

One aspect of the invention is directed to a mechanism for cleaning out an inlet grate which extends across an inlet of a duct of a water jet propulsion system. The mechanism comprises an actuator penetrating the duct and a wiper supported by the actuator and disposed across the tines of the inlet grate. The actuator is linearly displaceable. The wiper bears against at least one tine during linear displacement of the actuator from a first position to a second position. The inlet grate pivots from a first angular position to a second angular position as the actuator displaces from the first position to the second position.

Another aspect of the invention is directed to a boat hull comprising: an inlet ramp defining a channel; an inlet grate comprising a plurality of cantilever tines and pivotably mounted to the inlet ramp with its tines extending at least partly across said channel; an actuator which penetrates the inlet ramp and is linearly displaceable; and a wiper supported by the actuator and disposed across the tines. The wiper bears against the tines and causes the inlet grate to pivot, at the same time wiping the tines, as previously described.

In accordance with other aspects of the invention, an inlet grate and a grate clean-out actuator are both coupled to a through-hull housing to form a module or assembly which can be installed in an opening of an inlet ramp formed in the hull. The invention encompasses both a module housing a pivotable inlet grate and a grate clean-out actuator, and a boat hull having such a module installed in an opening in the hull.

In accordance with the preferred embodiment, the actuator penetrates and is supported by a through-hull housing installed in an opening in the hull. The actuator is linearly displaceable relative to the through-hull housing by manipulation of a handle or other operator input device or system. An inlet grate comprising a plurality of cantilever tines is pivotably mounted to and supported by the through-hull housing. A weed wiper is connected to the end of the actuator remote from the end that is actuated by the boat operator. When the actuator is displaced downward, the weed wiper moves downward along a linear path. At the point in the wiper displacement where the wiper bar engages the tines of the inlet grate, the downwardly displacing weed wiper causes the grate to pivot downward. During this action, the wiper slides across the grate and pushes any weeds or other debris entangled on the grate toward the ends of the tines. Because weeds usually wrap and ball around the inlet grate tines, the weeds will slide off easily when pushed or dragged by the sweeping wiper bar.

In accordance with another preferred embodiment, a device is provided which comprises a cantilevered inlet grate mounted on a single-direction pivot with spring return; a weed removal bar; and an actuation rod. The design intent of this grate is to combine the passive weed shedding of a cantilevered grate with an active weed removal system. During normal passive operation, the majority of weeds caught by the grate will be drawn by fluid forces towards the free ends of the tines and slide off. During this phase the grate tines are stationary, forced against the pivot stop by the water flow through the pump inlet. The active mode of operation is used when the inlet grate becomes severely entangled with weeds and pump performance is degraded. The weeds are removed by depressing the actuator rod, which causes the weed removal bar to move in a linear motion and come into contact with the inlet grate, causing it to pivot downward and opening up the gap between the free ends of the tines and the inlet lip. The bar slides down the grate, pushing the entangled weeds off the ends of the tines. Releasing the spring-loaded actuation rod automatically causes all components to retract back into their original positions.

DETAILED DESCRIPTION OF THE PREFERRED EMBODIMENTS

Figure 1:
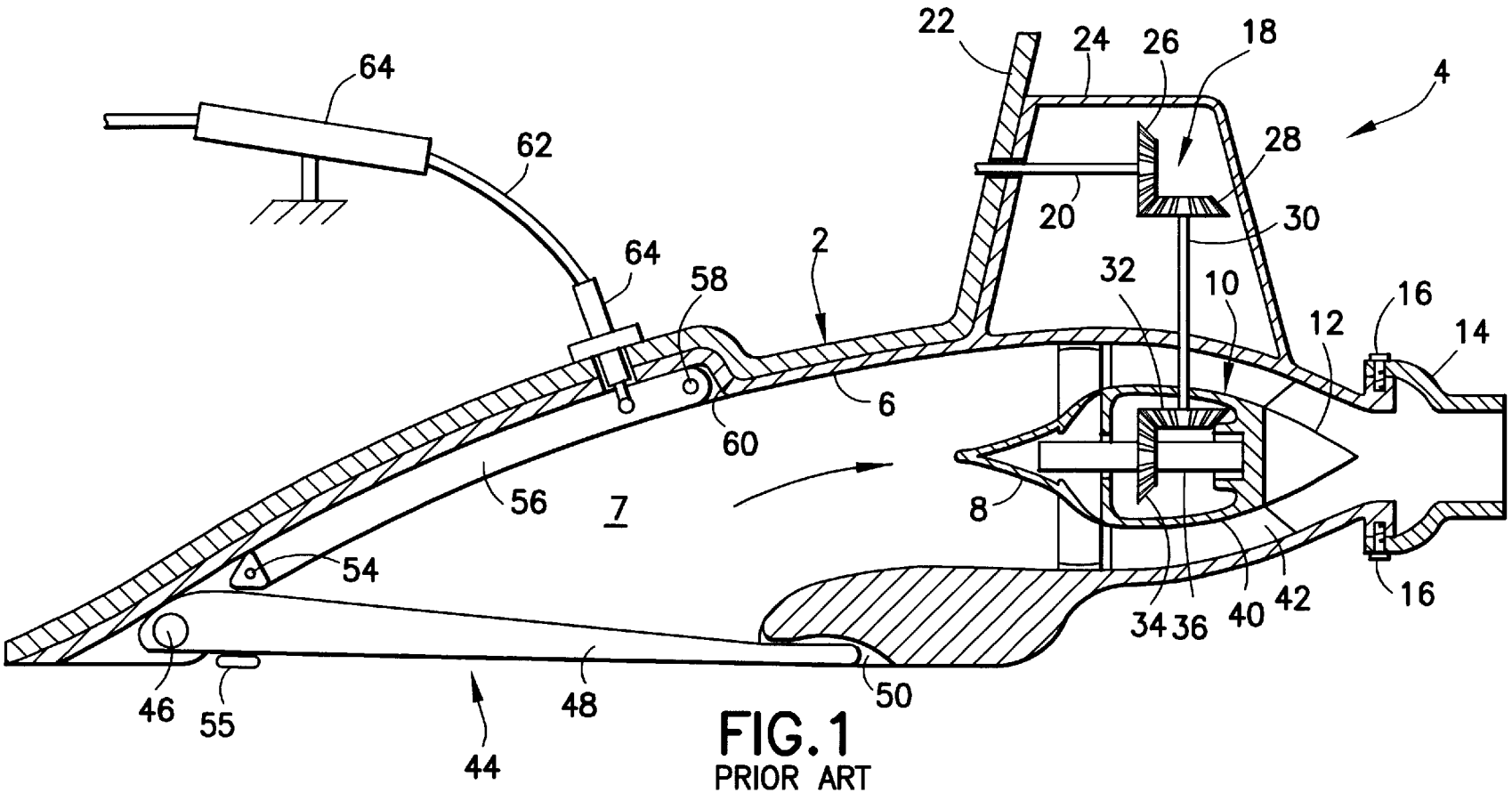
FIG. 1 PRIOR ART
FIG. 1 is a schematic showing a sectional view of a water jet apparatus incorporating a weed grate clean-out system in accordance with a prior art teaching.
Figure 2:
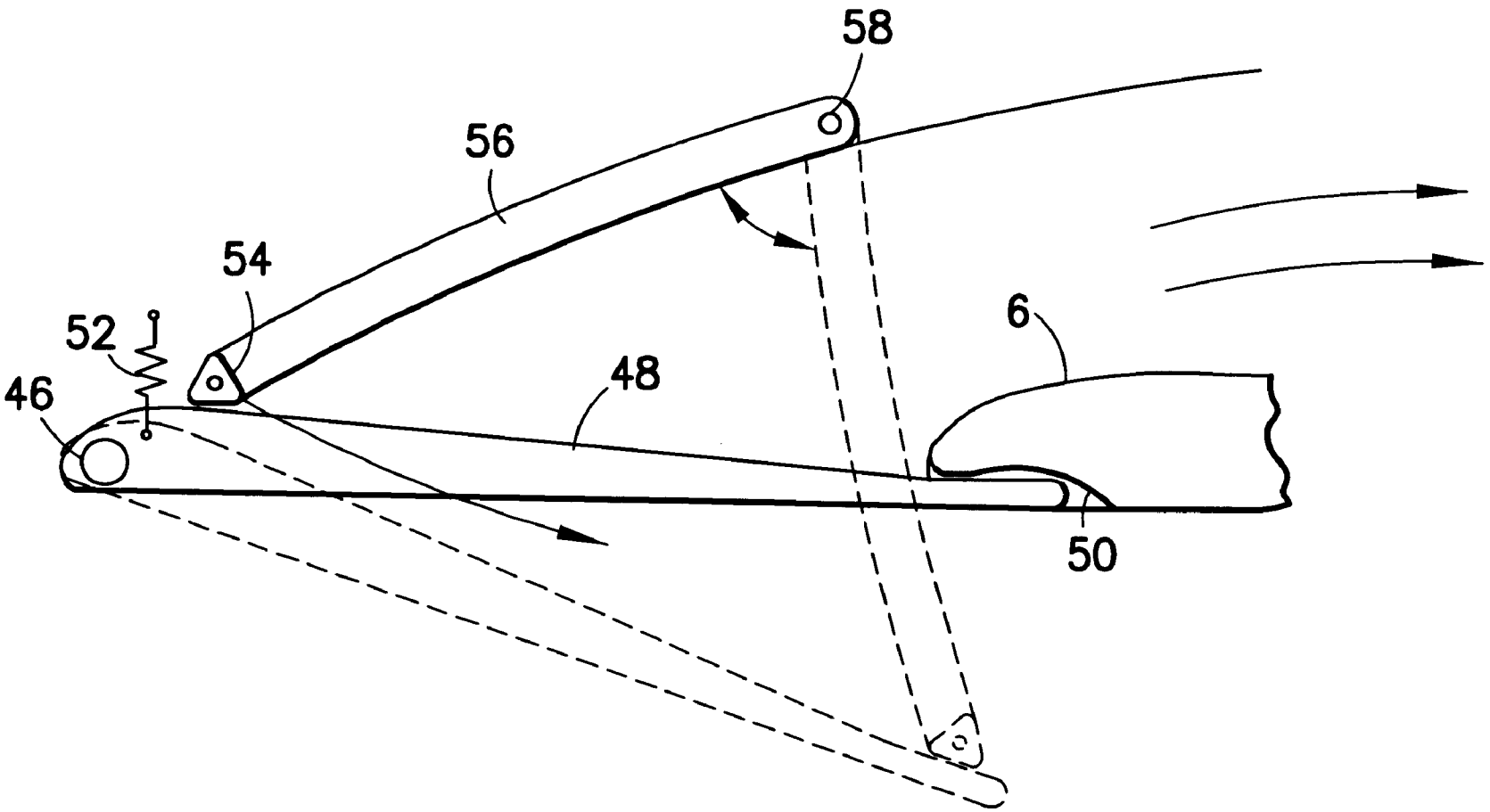
FIG.2 PRIOR ART
FIG. 2 is a schematic showing operation of the weed grate clean-out system depicted in FIG. 1, with the running position depicted by solid lines and the clean-out position depicted by dashed lines.
Figure 3:
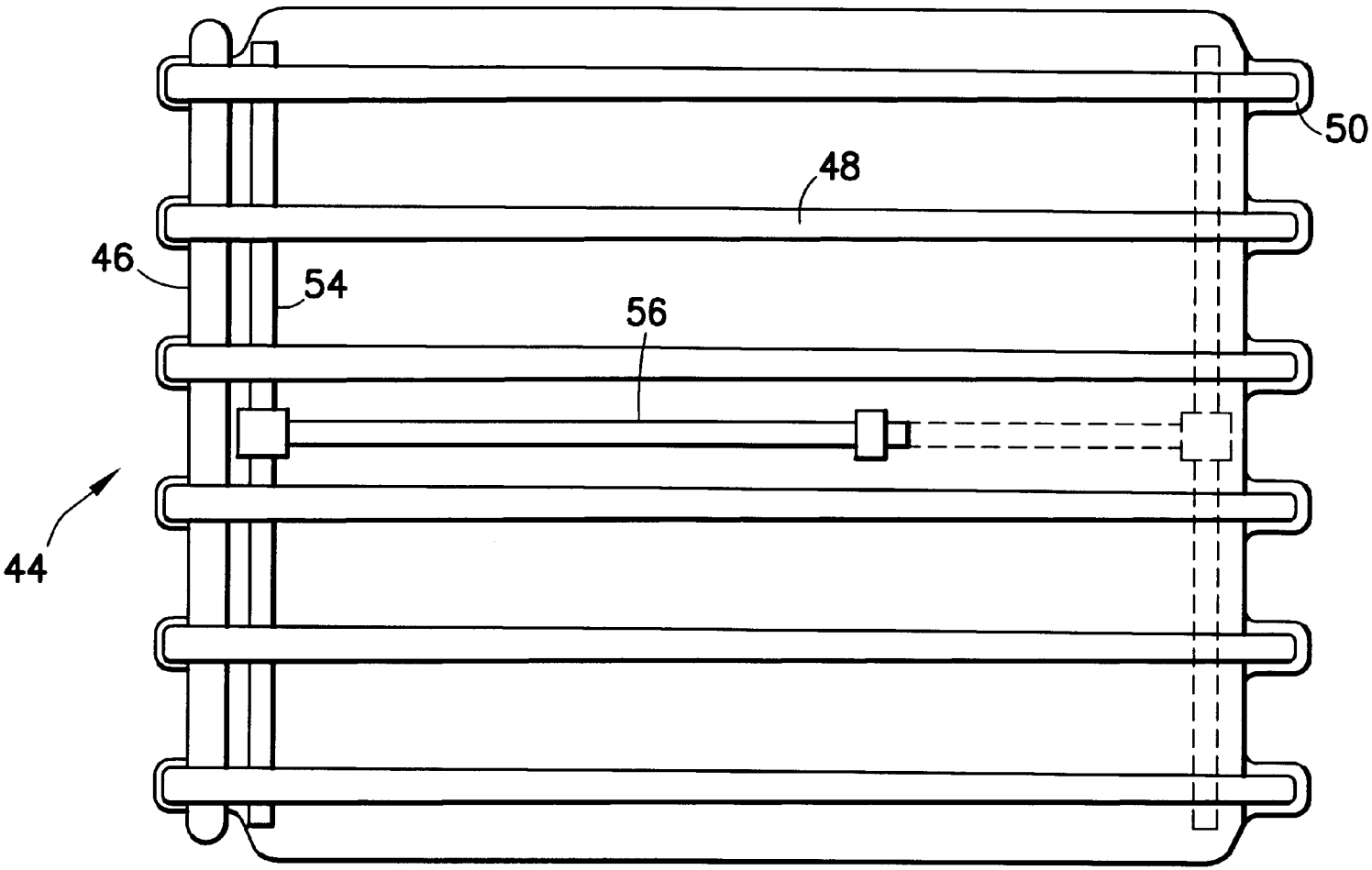
FIG. 3 PRIOR ART
FIG. 3 is a schematic showing a bottom view of the weed grate clean-out system depicted in FIG. 1.

A known mechanism for cleaning out the inlet grate of a water jet propulsion system is depicted in FIGS. 1–3, taken from U.S. Pat. No. 6,083,063. These drawings disclose the basic structure components of a water jet propulsion system and the basic structure of an inlet grate having cantilevered tines. With this background, the description of the preferred embodiment, made with reference to FIG. 4 later, will be more readily understandable.

FIG. 1 shows a portion of a boat hull 2 having a cavity in which an inlet portion of a water jet apparatus 4 is installed. The inlet portion may comprise a separate component such as an inlet housing or may comprise the forward section of a water jet housing which houses the impeller. FIG. 1 shows a single housing 6 which houses an impeller 8 having a plurality of blades, a stator 10 having a plurality of stator vanes, and a tail cone 12. The interior surfaces of housing 6 form a duct which defines a water tunnel or channel 7.

FIG. 1 also shows a steering nozzle 14 which is pivotably mounted to the housing 6 at the outlet of the housing, the steering nozzle being pivotable about a vertical axis defined by the centerline of a pair of pivot pins 16 to enable steering the boat. For the purpose of illustration, one type of gear drive train 18 is depicted for coupling to an inboard motor (not shown). In the exemplary drive train shown in FIG. 1, a horizontal drive shaft 20 is coupled to an output shaft (not shown) of the inboard motor. The drive shaft 20 penetrates the transom 22 and extends into the upper gear housing 24. A bevel drive gear 26 is mounted to the end of drive shaft 20. The teeth of bevel drive gear 26 mesh with a bevel gear 28 mounted to the end of a vertical drive shaft 30, which penetrates the water jet housing 6. The opposite end of the vertical drive shaft 30 has a bevel gear 32 mounted thereto. The bevel gear 32 in turn meshes with a bevel gear 34 mounted on an impeller shaft 36 which has a portion extending forward of the vertical shaft 30. The impeller (i.e., rotor) 8 is mounted on the forward end of the impeller shaft 36 and may have a conventional structure.

The impeller shaft 36 is supported by bearings (not shown) arranged inside a hollow hub 40 of stator 10 having a streamlined exterior surface. The stator hub 40 is surrounded by housing 6. The interior surface of housing 6 is streamlined, so that the opposing surfaces of the housing 6 and hub 40 define a circumferential passageway through which the impelled water flows. The circumferential passageway forms part of the water tunnel 7. The housing 6 and hub 40 are preferably connected by a plurality of stator vanes 42.

In accordance with the exemplary drive train described above, an inboard engine provides a torque which drives the impeller shaft 36 to rotate via drive shafts 20 and 30, and gears 26, 28, 32, and 34. Rotation of the impeller shaft 36 in turn causes the impeller 8 to rotate. During rotation, the angled blades of the impeller 8 impel water in the aft direction through the circumferential passageway between housing 6 and hub 40. The stator vanes 42 function to redirect the swirling flow out of the impeller and eliminate swirl. The water exits the steering nozzle 14 as a downstream jet.

In accordance with the system depicted in FIGS. 1–3, weeds and other debris are prevented from entering the water tunnel 7 by an inlet grate 44 which is pivotably mounted to the housing 6. The inlet grate 44 comprises a base 46 and a plurality of spaced cantilever tines 48. The opposing ends of base 46 are pivotably mounted in the housing 6. The inlet grate is pivotable about a pivot axis in a downward direction. During normal operation of the water jet apparatus, the inlet grate is in a so-called "running" or passive position, which is indicated by solid lines in FIG. 2. During a clean-out operation, the inlet grate is pivoted downward to a so-called "clean-out" or active position indicated by dashed lines in FIG. 2. The housing has recesses 50, best seen in FIG. 3, which each receive a tip of a respective cantilever tine when the inlet grate is in the running position. A spring 52 (shown only in FIG. 2) holds the inlet grate in the passive position and urges the inlet grate 44 to return from the active position to the passive position. The spring 52 can be anchored to the housing.

The weed grate clean-out system depicted in FIGS. 1–3 comprises a wiper for wiping the tines 48 in a lengthwise direction while simultaneously causing the inlet grate 44 to pivot downward. The wiper comprises a wiper bar 54 disposed across the tines 48 and movable between first and second positions by actuation of a wiper arm 56, which is pivotably mounted to the housing 6 by a pivot pin 58. When the inlet grate 44 is in the running position, the wiper arm 56 is retracted into a recess 60 formed in housing 6. The retracted position of the wiper arm 56 is indicated by solid lines in FIG. 2. In response to operator actuation, the wiper arm rotates to an extended position indicated by dashed lines in FIG. 2. The wiper arm can be actuated to rotate by any conventional mechanical or electromechanical means. FIG. 1 shows a push-pull cable 62 which is slidable inside one or more tubes 64 affixed to the boat and which penetrates the hull 2 and the housing 6. One end of cable 62 is connected to a handle (not shown) manipulated by the boat operator. The other end of cable 62 is pivotably coupled to the wiper arm 56 to facilitate adjustment of the angular position of the cable end relative to the wiper arm during displacement of the former and pivoting of the latter. The wiper bar 54 bears against at least one of the cantilever tines 48 during movement of the wiper bar from a first position, when the wiper arm 58 is retracted, to a second position, when the wiper arm is extended. The wiper bar is pivotably mounted to the wiper arm. The wiper incorporates a return member 55 which is mechanically linked to the wiper bar 54 (the linkage is not shown in FIG. 1) and disposed on the underside of the inlet grate such that the return member 55 pushes the inlet grate up as the wiper bar is returned to the running position.

The first and second positions of a pivotable wiper bar 54 are depicted in FIG. 3 by solid and dashed lines respectively. Preferably the wiper bar has a cross section such that the surface which bears against the inlet grate is relatively flat so that the wiper bar will slide, not roll, along the length of the tines. The wiper bar 54 sweeps across the tines 48 from the first position to the second position as the wiper arm 56 is actuated to rotate from its retracted position to its extended position (shown in FIG. 2). As the wiper bar sweeps across the tines, it pushes or drags clumps of debris which might be ensnarled or accumulated on the tines toward the tips of the tines. At the same time, in the passive or running position of the inlet grate, the tines 48 are disposed inside the arc which the wiper bar 54 will travel during extension of the wiper arm 56. In response to the interference presented by the tines with which the wiper bar is in contact, the wiper bar will push the inlet grate out of the path of the wiper bar, causing the inlet grate to pivot downward toward the active or clean-out position indicated by dashed lines in FIG. 2. In the clean-out position, the tips of the tines are separated from the aft edge of the inlet opening by a distance sufficient to allow clumps of weeds or other debris to be pushed of off the inlet grate by the wiper bar. After the inlet grate has been unclogged, the boat operator actuates the wiper arm to rotate from its extended position to its retracted position, during which the spring 52 urges the inlet grate toward the running position.

The preferred embodiment of the present invention differs from the system shown in FIGS. 1–3 in that the actuator is linearly displaceable instead of being pivotable. Furthermore, in the passive grate position, the ends of the cantilevered tines do not contact the lower lip of the housing of the water jet propulsion unit, but rather there is a gap which leaves the tine ends free for weeds or other debris to slide off. Another difference lies in the fact that the inlet grate in accordance with the preferred embodiment is pivotably mounted to the hull, i.e., to a through-hull housing installed in an opening in the hull, rather than to the housing of the water jet propulsion unit. The linearly displaceable actuator penetrates and is supported by the same through-hull housing. It should be further appreciated that the water jet propulsion unit and the through-hull housing can be designed to enable the impeller drive shaft to pass through the through-hull housing to the inboard motor. In the latter case, the actuator and the wiper bar must be situated so that there is clearance for the drive shaft.

Figure 4:
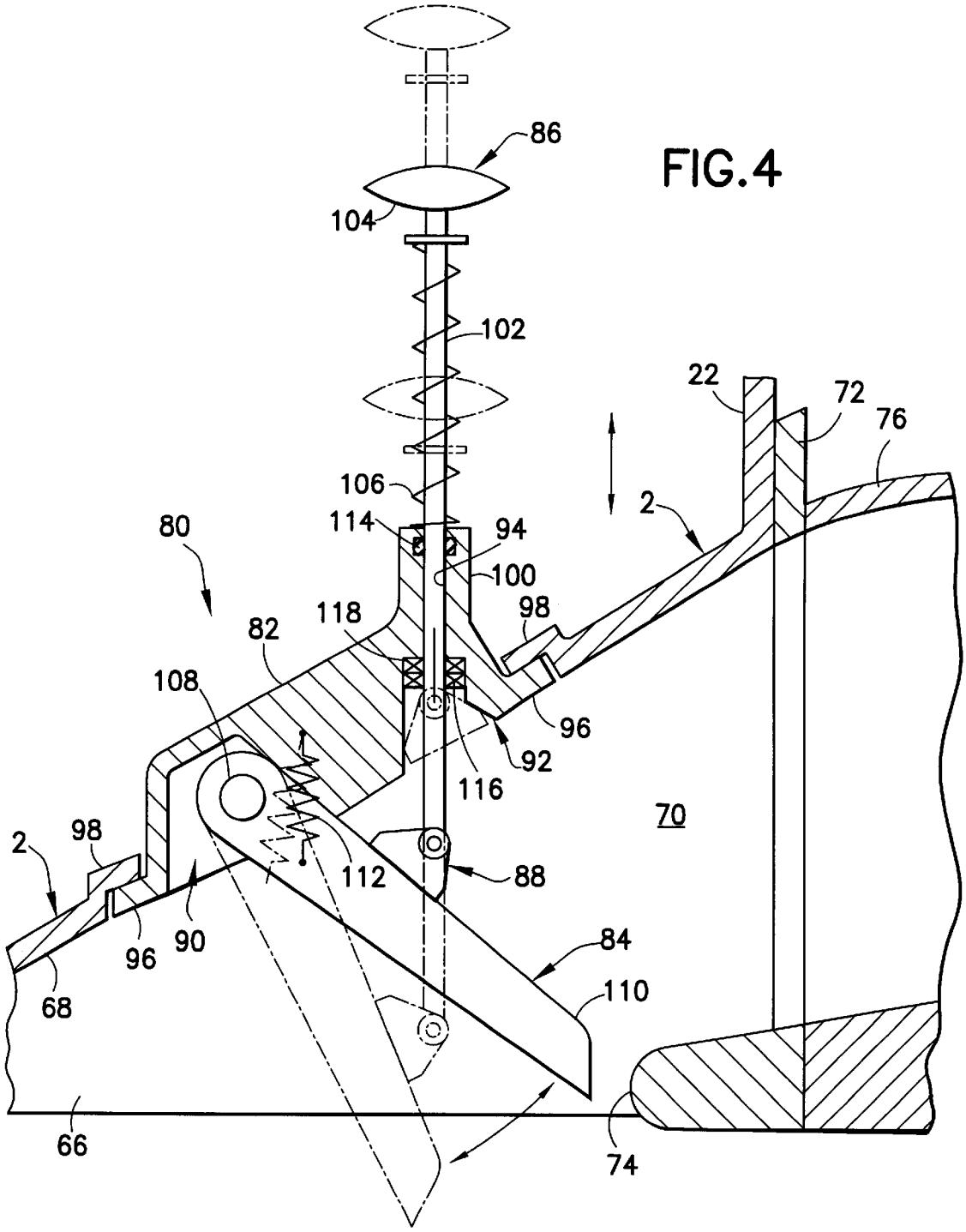
FIG. 4 is a schematic showing a sectional view of a portion of the stern of a boat incorporating a weed grate clean-out system in accordance with the preferred embodiment of the present invention. The passive clean-out positions of the moving components are indicated by solid lines, while the active clean-out positions of the moving components are indicated by dashed lines.

The preferred embodiment of the invention is depicted in FIG. 4. In accordance with this embodiment, an inlet ramp is formed during molding of the boat hull. The inlet ramp comprises a pair of opposing sidewalls 66 (only one of which is visible in FIG. 4) which increase in height continuously from a starting point on the hull bottom to the respective points where the sidewalls join the transom 22. The top edges of the opposing sidewalls 66 are connected by a ramp ceiling 68, which curves continuously upward. The sidewalls and ceiling form part of the molded hull bottom and define an inlet channel 70. Optionally, the junctures connecting the sidewalls to the ceiling may be formed as rounded corners.

A mounting adapter 72 in the form of a flanged ring having a rounded lower lip 74 is mounted to the rear face of the transom 22. The bottom edges of the inlet ramp and the forward tip of the lower lip 74 define an inlet opening for entry of ambient water into the inlet channel 70. The mounting adapter 72 is mounted to the transom 22 by fasteners (not shown). The water jet propulsion unit is in turn mounted to the mounting adapter 72 in cantilever fashion in a well-known manner. For example, the water jet propulsion unit may comprise an impeller housing 76 connected to the mounting adapter, a stator housing (not shown in FIG. 4) connected to the impeller housing, a discharge nozzle (not shown in FIG. 4) connected to the stator housing, and a steering nozzle (not shown in FIG. 4) pivotably mounted to the discharge nozzle. The entire assembly extends from the mounting adapter in cantilever fashion. The outlet of the discharge nozzle is in flow communication with the inlet opening via the inlet ramp, the mounting adapter, the impeller housing and the stator housing. All of these components, communicating with each other in series, form a duct.

As seen in FIG. 4, the preferred embodiment of the invention comprises a module or assembly 80 installed in an opening in the hull bottom, i.e., in the ceiling 68 of the inlet ramp. The assembly comprises a housing 82, an inlet grate 84, an actuator 86 and a wiper 88. Any conventional means may be used to install the module 80 in the opening in the inlet ramp ceiling. For example, the housing 82 may be provided with a peripheral mounting flange 96 which bolts to a matching mounting flange 98 formed along the periphery of the opening in the hull. Alternatively, a separate mounting plate could be used to clamp the housing 82 to the inlet ramp ceiling.

The housing 82 has a first recess 90 for receiving a base portion of the inlet grate 84, a second recess 92 for receiving the wiper, and a linear bore 94 communicating with the second recess for passage of the actuator 86. The linear bore 94 extends upward through a boss 100 formed as an integral part of the housing 82.

In the preferred embodiment, the actuator 86 comprises a rod 102, which slides in and is guided by the linear bore 94, and a handle 104. The actuator 86 slides downward from a fully up position to a fully down position when a person in the stern of the boat depresses a handle 104 connected to the top end of the rod 102. The wiper 88 preferably takes the form of a bar pivotably mounted to the lower end of the rod 102. In the passive position, the rod 102 is fully up and the wiper bar 88 resides in the recess 92 of housing 82. In the active position, the rod 102 is displaced downward and the wiper bar 88 extends into the channel 70. During operation of the water jet propulsion unit, the wiper bar 88 resides in the recess 92 so that the wiper bar does not obstruct water flow through the inlet ramp channel 70. The actuator is spring-loaded with a return compression spring 106 so that the wiper bar 88 retracts automatically into recess 92 when the handle 104 is released.

To aid sliding of the rod 102 in the linear bore 94, grease may be applied to the rod surface. An O-ring 114 is seated in an annular recess formed in the boss 100 to wipe the rod surface, thereby acting as a dam against upward escape of grease. A double-seal arrangement is installed in an annular recess which communicates with the second recess 92. The lower seal 116 is designed to prevent the entry of water from the inlet channel 70 into the linear bore 94, while the upper seal 118 wipes the rod surface, again to block the grease from escaping.

In the preferred embodiment, the inlet grate 84 comprises a base 108 and a plurality of spaced mutually parallel cantilever tines 110. As seen in FIG. 4, the length of the tines 110 is such that there is a gap between the ends of the tines and the lower lip 74 of the mounting adapter 72. This gap allows weeds or other debris to slide off the tines even when the inlet grate is in the passive position. Preferably the tines are tapered along their length, with the taper being dramatically increased near the free ends of the tines. The opposing ends of base 108 are pivotably mounted in the recess 90 of housing 82. The inlet grate 84 is urged toward the passive position by a spring 112. The passive position is defined by a stop surface formed as part of housing 82, which stop surface blocks further pivoting of the inlet grate in the return direction.

In accordance with the preferred embodiment, the actuator is linearly displaceable between up and down positions, while the inlet grate is pivotable between first and second angular positions, depicted in FIG. 4 by solid and dashed lines respectively. As the actuator 86 is moved downward from the fully up position indicated by solid lines in FIG. 4, the wiper bar 88 eventually engages at least one tine 110. This engagement causes the wiper bar to pivot during the next increment in downward displacement of the actuator, until a planar forward face of the wiper bar 88 lies flat against the upper edges of the tines 110. Thereafter, during further downward displacement of the actuator 86, the wiper bar 88 will both bear against and slide along the upper edges of the tines 110, causing the inlet grate to pivot from the first angular position (indicated by solid lines in FIG. 4) to the second angular position (shown by dashed lines in FIG. 4). If weeds and/or other debris are entangled on the distal sections of the tines, the wiping action of the wiper bar will push the entangled matter off of the free ends of the tines.

While the invention has been described with reference to a preferred embodiment, it will be understood by those skilled in the art that various changes may be made and equivalents may be substituted for elements thereof without departing from the scope of the invention. For example, it will be apparent to a person skilled in the art that the cantilever tines of the inlet grate could be independently pivotable instead of being connected to a common pivotable base. Also, means other than a push rod can be used to actuate the clean-out system disclosed above. For example, clean-out could be actuated by the boat operator using a wheel connected to a jack screw, which is in turn mechanically coupled to the wiper. Alternatively, electromechanical means could be used to actuate rotation of the wiper, in which case clean-out could be actuated by depression of a pushbutton on a control panel. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "duct" means any structure which defines a channel having an inlet and an outlet. The structure may comprise a single cast piece or an assembly of components. In the preferred embodiment disclosed above, the duct comprises three main components: an inlet ramp formed in the hull bottom, a through-hull housing for the inlet grate and the actuator that is installed in an opening in the hull, and a housing (or series of housings) of a water jet propulsion unit attached to the hull. However, the invention encompasses, for example, forming the inlet ramp and the grate/actuator housing as integral parts of the hull, or forming the inlet ramp and the grate/actuator housing integrally with the housing (or inlet housing) of the water jet propulsion unit.

What is claimed is:

1. A water jet propulsion system comprising:

a duct having an inlet and an outlet connected by a channel;

an impeller rotatable within said duct;

an inlet grate comprising a plurality of cantilever tines, said inlet grate being pivotably mounted to said duct and positioned so that said tines extend at least partly across said channel;

an actuator which penetrates said duct and is displaceable along a linear path between first and second positions, said actuator having upper and lower ends; and a wiper supported by said lower end of said actuator, said wiper protruding into said channel when said actuator is in said second position but not when said actuator is in said first position, said wiper engaging at least one of said tines during displacement of said actuator along a portion of said linear path from a third position to said second position, said third position being intermediate said first and second positions, wherein said inlet grate pivots from a first angular position to a second angular position as said actuator displaces from said third position to said second position.

2. The system as recited in claim 1, wherein said duct comprises a lower lip, the ends of said tines being separated from said lower lip by a first gap when said inlet grate is in said first angular position and by a second gap when said inlet grate is in said second angular position, said second gap being greater than said first gap.

3. The system as recited in claim 1, wherein said wiper is pivotably coupled to said lower end of said actuator.

4. The system as recited in claim 1, wherein said duct comprises a recess for receiving said wiper when said actuator is in said first position.

5. The system as recited in claim 4, wherein said wiper must adopt a predetermined orientation relative to said actuator in order to fit inside said recess.

6. The system as recited in claim 1, wherein said duct comprises a linear bore for penetration by said actuator, further comprising a seal surrounding said actuator adjacent said linear bore.

7. The system as recited in claim 1, further comprising a spring which is compressed when said actuator displaces from said first position to said second position, said compressed spring exerting a force for returning said actuator to said first position.

8. The system as recited in claim 7, further comprising a member connected to said upper end of said actuator, wherein said spring is compressed by said member during downward displacement of said actuator.

9. The system as recited in claim 1, wherein said duct comprises a housing, said actuator penetrating said housing, and said inlet grate being pivotably coupled to said housing.

10. The system as recited in claim 9, wherein said duct further comprises an inlet ramp formed as part of a boat hull, said inlet ramp comprising an opening in which said housing is installed.

11. The system as recited in claim 1, wherein said actuator comprises a slidable rod.

12. A water jet propulsion system comprising:

a duct having an inlet and an outlet connected by a channel;

an impeller rotatable within said duct;

an inlet grate comprising a plurality of cantilever tines which are pivotable relative to said duct and which are arranged so that water entering said duct flows between said tines;

an actuator penetrating said duct, said actuator being linearly displaceable; and a wiper supported by said actuator and disposed across said tines, said wiper bearing against at least one of said tines during linear displacement of said actuator from a first position to a second position, wherein said inlet grate pivots from a first angular position to a second angular position as said actuator displaces from said first position to said second position.

13. The system as recited in claim 12, wherein said duct comprises a lower lip, the ends of said tines being separated from said lower lip by a first gap when said inlet grate is in said first angular position and by a second gap when said inlet grate is in said second angular position, said second gap being greater than said first gap.

14. The system as recited in claim 12, wherein said inlet grate further comprises a base pivotably mounted to said duct, said tines being connected to said base.

15. The system as recited in claim 12, wherein said actuator comprises a slidable rod.

16. The system as recited in claim 12, wherein said wiper is pivotably coupled to said actuator.

17. The system as recited in claim 12, wherein said duct comprising a recess for receiving said wiper when said actuator is in a retracted state.

18. An assembly comprising:

a housing comprising first and second recesses and a linear bore communicating with said second recess;

an inlet grate comprising a plurality of cantilever tines connected to a base member, said inlet grate being pivotably mounted to said housing, and said base member being housed in said first recess;

an actuator which passes through said linear bore; and a wiper supported by an end of said actuator, said wiper engaging at least one of said tines during linear displacement of said actuator from a first position relative to said housing to a second position relative to said housing, wherein said inlet grate pivots from a first angular position relative to said housing to a second angular position relative to said housing as said actuator displaces from said first position to said second position.

19. The assembly as recited in claim 18, wherein said housing comprises a mounting flange along its periphery.

20. The assembly as recited in claim 18, wherein said wiper is pivotably coupled to said end of said actuator.

21. The assembly as recited in claim 18, wherein said actuator displaces along an axis which is generally perpendicular to a pivot axis of said inlet grate.

22. The assembly as recited in claim 18, further comprising a seal surrounding said actuator adjacent said linear bore.

23. The assembly as recited in claim 18, further comprising a spring which is compressed when said actuator displaces from said first position to said second position, said compressed spring exerting a force for returning said actuator to said first position.

24. The assembly as recited in claim 18, further comprising a spring coupled to said inlet grate for urging said inlet grate to pivot from said second angular position to said first angular position.

25. A boat hull comprising:

a hull bottom;

a stern wall;

an inlet ramp starting on said hull bottom and extending to said stern wall, said inlet ramp defining a channel and comprising an opening;

a housing installed in said opening;

an inlet grate comprising a plurality of cantilever tines, said inlet grate being pivotably mounted to said housing, and said tines extending into said channel; and an inlet grate clean-out assembly penetrating and supported by said housing and activatable to engage said inlet grate.

26. The boat hull as recited in claim 25, further comprising an actuator which penetrates and is linearly displaceable relative to said housing.

27. The boat hull as recited in claim 26, further comprising a wiper supported by an end of said actuator, said wiper engaging at least one of said tines during linear displacement of said actuator from a first position relative to said housing to a second position relative to said housing, wherein said inlet grate pivots from a first angular position relative to said housing to a second angular position relative to said housing as said actuator displaces from said first position to said second position.

28. The boat hull as recited in claim 25, further comprising means for wiping said tines in a lengthwise direction while simultaneously causing said inlet grate to pivot downward, said wiping means being coupled to said housing.

29. The boat hull as recited in claim 27, wherein said wiper is pivotably coupled to a lower end of said actuator.

30. The boat hull as recited in claim 29, wherein said housing comprises a recess for receiving said wiper.

31. The boat hull as recited in claim 26, wherein said actuator comprises a sliding rod.

32. The boat hull as recited in claim 31, wherein said housing comprises a linear bore in which said sliding rod slides, further comprising a seal surrounding said sliding rod adjacent said linear bore.

33. The boat hull as recited in claim 27, further comprising a spring which is compressed when said actuator displaces from said first position to said second position, said compressed spring exerting a force for returning said actuator to said first position.

34. A boat hull comprising:

an inlet ramp defining a channel;

an inlet grate comprising a plurality of cantilever tines, said inlet grate being pivotably mounted to said inlet ramp and positioned so that said tines extend at least partly across said channel;

an actuator which penetrates said inlet ramp and is linearly displaceable; and a wiper supported by said actuator and disposed across said tines, said wiper bearing against at least one of said tines during linear displacement of said actuator from a first position to a second position, wherein said inlet grate pivots from a first angular position to a second angular position as said actuator displaces from said first position to said second position.

35. The boat hull as recited in claim 34, wherein said inlet ramp comprises a linear bore for guiding said actuator to displace linearly.

36. The boat hull as recited in claim 34, wherein said wiper is pivotably coupled to a lower end of said actuator.

37. The boat hull as recited in claim 34, wherein said inlet ramp comprises a recess for receiving said wiper.

38. The boat hull as recited in claim 34, wherein said actuator comprises a sliding rod.

* * * * *